US006247459B1

(12) United States Patent
Liao

(10) Patent No.: US 6,247,459 B1
(45) Date of Patent: Jun. 19, 2001

(54) MAGNETIZED DEVICE FOR AN AUTOMOBILE FUELING SYSTEM

(76) Inventor: Chun-yao Liao, No. 159, Lane 247, Ta Chiao 1st St., Yung Kang City, Tainan Hsien (TW)

( * ) Notice: Subject to any disclaimer, the term of this patent is extended or adjusted under 35 U.S.C. 154(b) by 0 days.

(21) Appl. No.: 09/632,975

(22) Filed: Aug. 4, 2000

(51) Int. Cl.[7] ..... F02M 33/00
(52) U.S. Cl. ..... 123/538
(58) Field of Search ..... 123/538, 537, 123/536; 210/222, 695

(56) References Cited

U.S. PATENT DOCUMENTS 4,711,271 * 12/1987 Weisenbarger et al. ..... 123/538
5,154,153 * 10/1992 MacGregor ..... 123/538
5,566,661 * 10/1996 Zorita ..... 123/538
5,589,065 * 12/1996 Bogatin et al. ..... 123/538
6,019,092 * 2/2000 Gilligan ..... 123/538
6,041,763 * 3/2000 Akyildiz ..... 123/538
6,178,953 * 1/2001 Cox ..... 123/537

* cited by examiner

*Primary Examiner*—Marguerite McMahon
(74) *Attorney, Agent, or Firm*—Rosenberg, Klein & Lee

(57) ABSTRACT

A magnetized device for an automobile fueling system comprises two nozzles being wrapped by oil seals and secured in a sleeve which also including a guiding post and two permanent magnets therein. The improvements comprise the two permanent magnets each has a positive polar and a negative polar at opposite end that will attract each other to form a hollow barrel and receive the guiding post therein to form a magnetized gasoline flow channel. Thus, when gasoline flows through the channel, the magnetized channel shall disperse the gasoline particles for easy burning.

3 Claims, 5 Drawing Sheets

MAGNETIZED DEVICE FOR AN AUTOMOBILE FUELING SYSTEM

FIELD OF THE INVENTION

This invention relates to a magnetized device for an automobile fueling system, and more particularly to a magnetized gasoline flow channel which disperses particles of gasoline for easy burning purpose.

Gasoline is one of the essential elements to operate the engine of an automobile. However, there are many particles mixed in gasoline which includes metals that can not be burned thoroughly and affect the operation of the vehicle.

The inventor, therefore, has invented the device which magnetizes the particles mixed in gasoline for a thorough burning.

SUMMARY OF THE INVENTION

It is the primary object of the present invention to provide a magnetized device for an automobile fueling system which magnetizes gasoline so that each particle may be separated and the gasoline can be burned thoroughly.

It is another object of the present invention to provide a magnetized device for an automobile fueling system which corresponds environmental requirement.

It is a further object of the present invention to provide a magnetized device for an automobile fueling system which is effective in cost.

DETAILED DESCRIPTION OF THE PREFERRED EMBODIMENT

Figure 1:
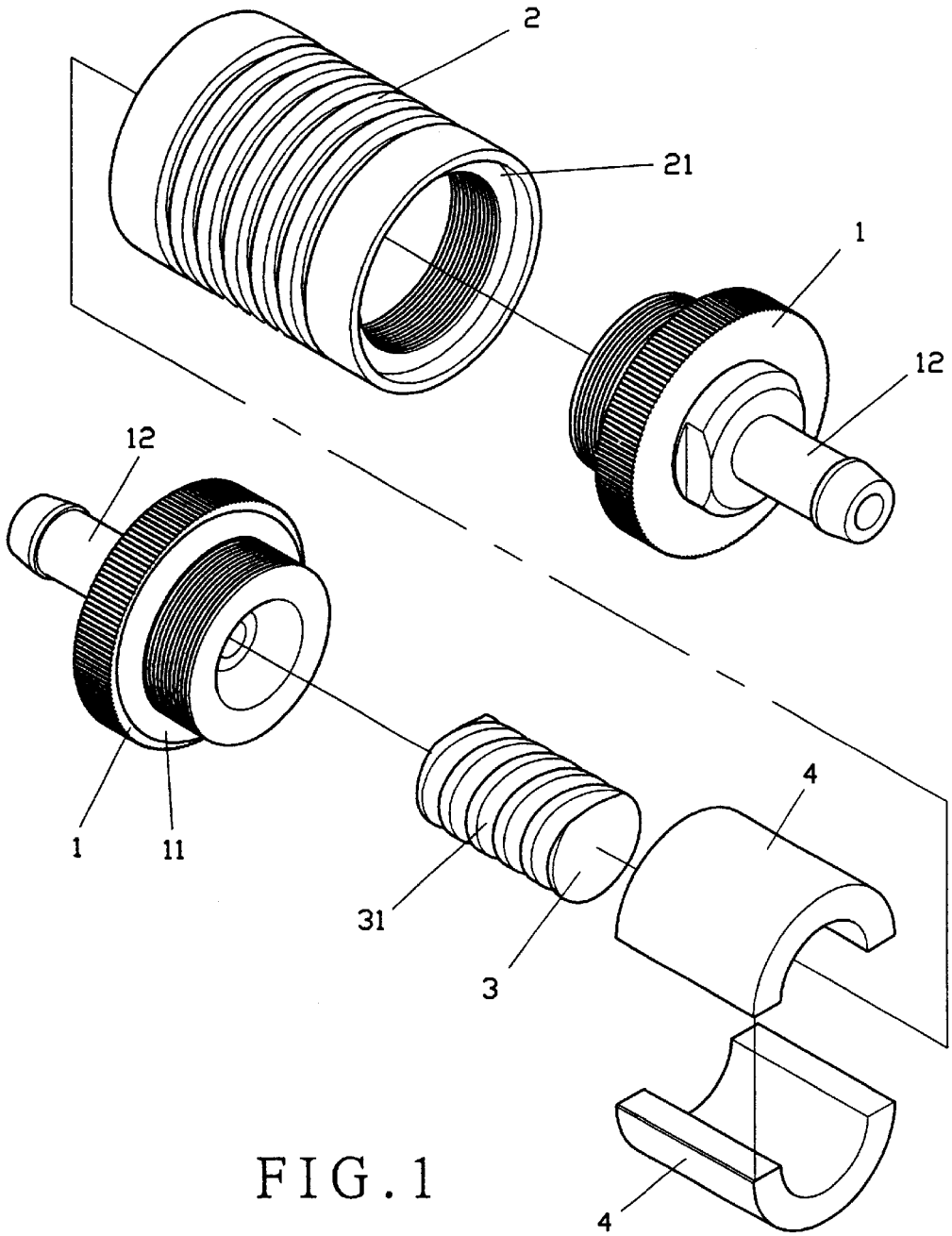
FIG. 1 is an exploded view of a first embodiment of the present invention.
Figure 2:
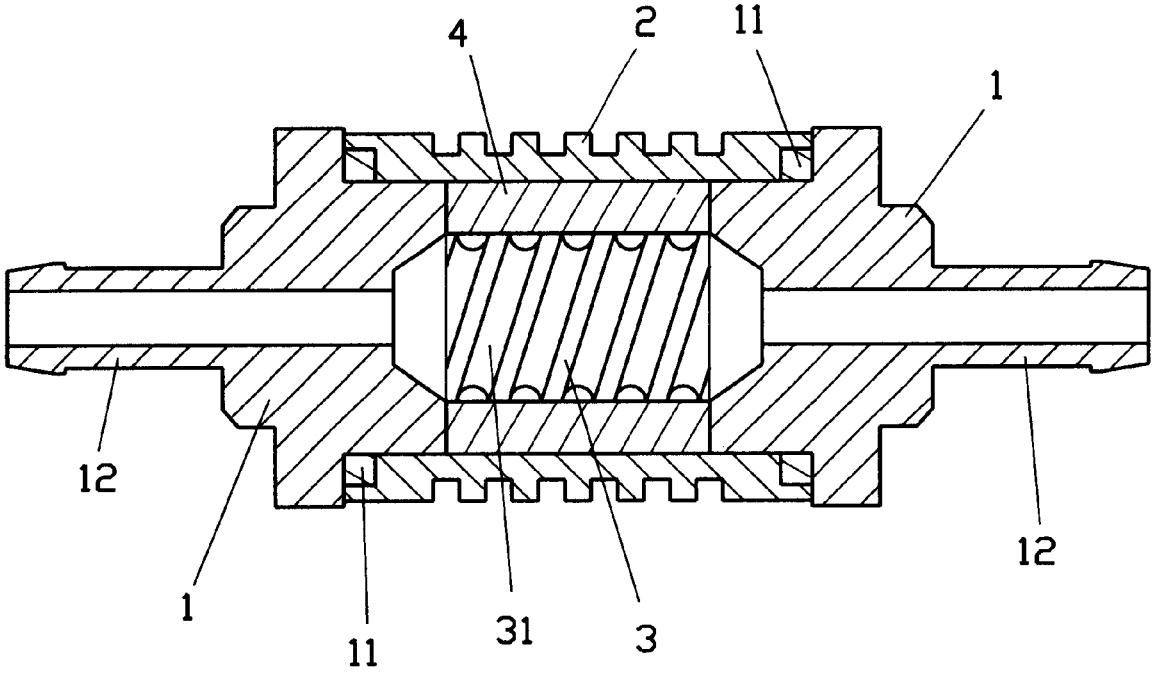
FIG. 2 is a cross view of the first embodiment of the present invention.

A magnetized device for an automobile gasoline system, as shown in FIG. 1, comprises two nozzles 1, a sleeve 2, a guiding post 3 and two permanent magnets.

Each nozzle 1 is enwrapped by an oil seal 11 and comprises a hollow pipe 12 extending from the center portion thereof, the nozzle 1 is formed with threads at one outer end.

The sleeve 2 is formed with a reduced portion 21 at one inner end and threads at respective inner ends therein.

The guiding post 3 is a post which is sized to be inserted into the sleeve 2. Outside of the guiding post 3 has a guiding rail 31 in a spiral shape. The guiding rail 31 starts from one end of the post 3 and ends at the other end thereof.

Each of the two permanent magnets 4 is in a half circular shape to wrap the guiding post 3.

In assembly, the two permanent magnets 4 are enclosed together which wrap the guiding post 3 therein to form a closed gasoline loop. The two nozzles 1 are threaded into the sleeve 2 from respective sides. The permanent magnets 4 and the guiding post 3 are sealed within the sleeve 2.

In practice, gasoline flows into the present invention through the hollow pipe 12 of the nozzle 1, the gasoline then flows through the guiding rail 31 of the guiding post 3 whereas the two permanent magnets 4 creates a magnet field to disperse the gasoline article for burning purpose.

Figure 3:
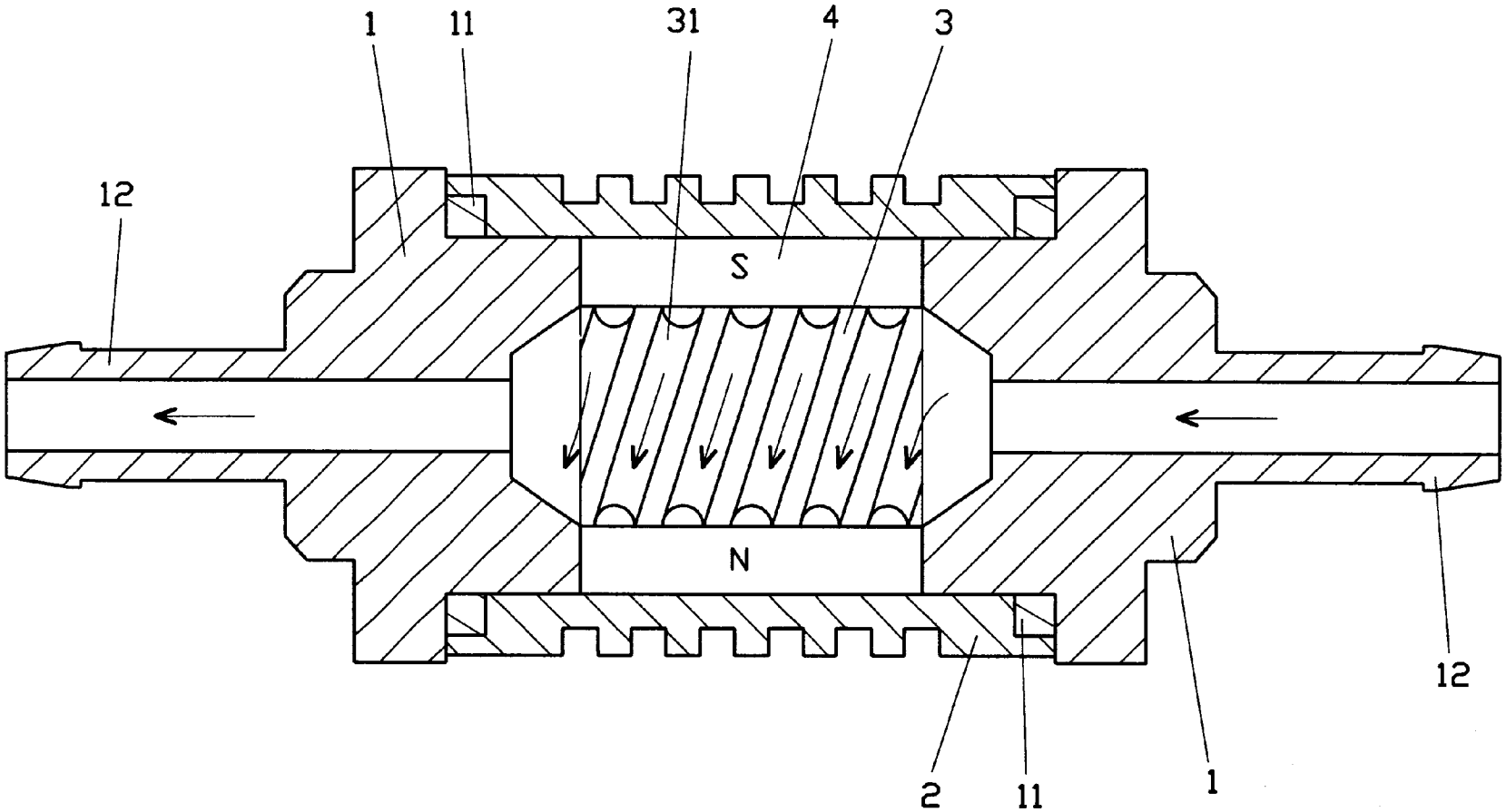
FIG. 3 is a view illustrating the embodiment of the present invention.

FIG. 3 has shown side view of the guiding rail 31 is formed in a spiral shape which increases the distance of gasoline flow, thus increases the gasoline magnifying time, thus increases the quality of gasoline to burn.

Figure 4:
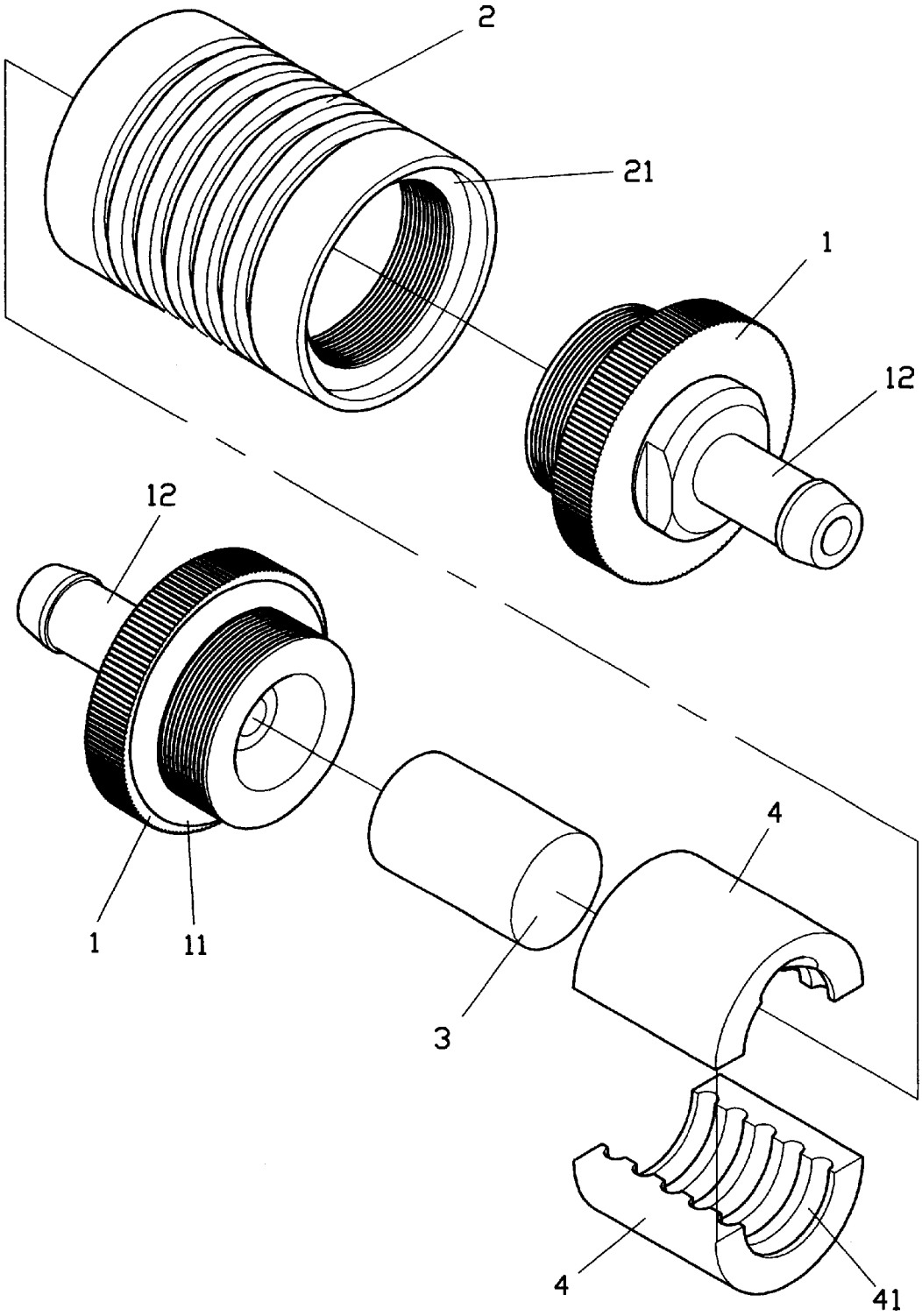
FIG. 4 is an exploded view of a second embodiment of the present invention.
Figure 5:
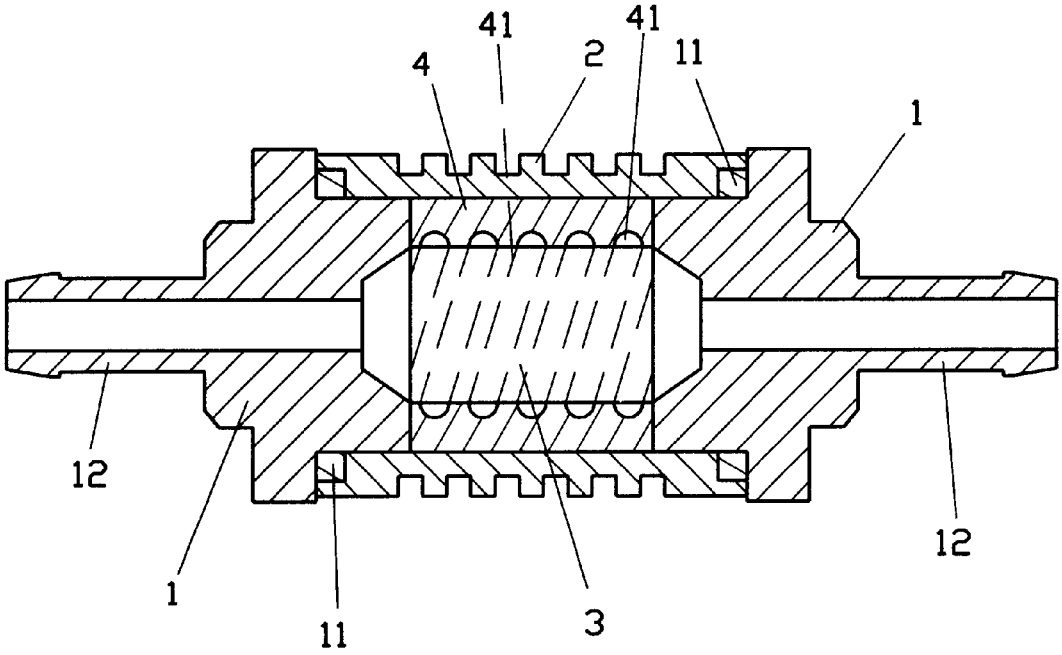
FIG. 5 is a cross view of the second embodiment of the present invention.

Each of the two permanent magnets 4 may be formed with slanting guiding rail 41 within the inner wall, so that when the magnets 4 are sealed together, the spiral shaped inner guiding rails 41 turn into the gasoline flowing channel and whereas the guiding post 3 is in a flat round post, as shown in FIG. 4.

To assemble the present invention, a gasoline channel is formed between the guiding rails 41 of the permanent magnets 4 and the guiding post 3, thus when flowing through this channel, gasoline is magnetized by the magnetic field of the permanent magnets 4.

I claim:

1. A magnetized device for an automobile fuelling system comprising two nozzles wrapped by an oil seal and secured in a sleeve, said sleeve comprising a guiding post and two permanent magnets therein, and the improvements comprising each said permanent magnet comprising a positive polar and a negative polar on opposite site attracting each other to enclose said guiding post therein forming a magnetized gasoline channel thereat.

2. The magnetized device for an automobile fuelling system, as recited in claim 1, wherein said guiding post is formed with a spiral shaped guiding rail around the outer wall.

3. The magnetized device for automobile fuelling system, as recited in claim 1, wherein each said permanent magnet is formed with a guiding rail at an inner wall and said guiding post is in a flat round post and a magnetized gasoline channel is formed when said permanent magnets being secured to enclose said guiding post therein.

* * * * *